US007418808B2

(12) United States Patent
van Beusekom

(10) Patent No.: US 7,418,808 B2
(45) Date of Patent: Sep. 2, 2008

(54) METHOD AND APPARATUS FOR FILLING CONTAINERS INCLUDING A SUPPORTING BAND

(75) Inventor: Hendrikus Johannes Maria van Beusekom, Hoevelaken (NL)

(73) Assignee: FPS Food Processing Systems B.V. (NL)

( * ) Notice: Subject to any disclaimer, the term of this patent is extended or adjusted under 35 U.S.C. 154(b) by 0 days.

(21) Appl. No.: 11/622,645

(22) Filed: Jan. 12, 2007

(65) Prior Publication Data

US 2007/0157549 A1 Jul. 12, 2007

(30) Foreign Application Priority Data

Jan. 12, 2006 (EP) ..... 06075080

(51) Int. Cl.
*B65B 5/10* (2006.01)

(52) U.S. Cl. ..... 53/447; 53/448; 53/475; 53/535; 53/540; 53/543; 53/245; 53/247; 53/248; 53/255; 53/258

(58) Field of Classification Search ..... 53/248, 53/247, 447, 475, 535, 536, 540, 541, 245, 53/448, 543, 260, 255, 258, 259
See application file for complete search history.

(56) References Cited

U.S. PATENT DOCUMENTS

| | | | | | |
|---|---|---|---|---|---|
| 2,668,651 | A * | 2/1954 | Jansen | 53/248 |
| 2,767,536 | A * | 10/1956 | Forkel | 53/245 |
| 3,001,350 | A * | 9/1961 | Heblij | 53/245 |
| 3,487,605 | A * | 1/1970 | Howard | 53/245 |
| 3,621,765 | A * | 11/1971 | Sootheran et al. | 493/91 |
| 3,653,178 | A * | 4/1972 | Bauer | 53/543 |
| 3,837,140 | A * | 9/1974 | Golantsev et al. | 53/540 |
| 3,879,919 | A * | 4/1975 | Walker et al. | 53/245 |
| 4,192,121 | A * | 3/1980 | Caudle | 53/248 |
| 4,573,847 | A * | 3/1986 | Howell et al. | 414/609 |
| 4,765,453 | A * | 8/1988 | Bucher | 198/431 |
| 4,785,611 | A * | 11/1988 | Hasenbalg | 53/536 |
| 4,815,258 | A * | 3/1989 | Jesperson et al. | 53/245 |
| 4,965,982 | A * | 10/1990 | Jesperson et al. | 53/248 |
| 5,172,537 | A * | 12/1992 | Wetter et al. | 53/572 |
| 5,440,862 | A * | 8/1995 | Sanchez-de-Leon-Rodriguez-Roda | 53/535 |
| 5,692,362 | A * | 12/1997 | Hoyland | 53/535 |
| 5,701,719 | A * | 12/1997 | Neukam | 53/247 |
| 5,733,088 | A * | 3/1998 | Kerrien et al. | 414/146 |
| 6,481,186 | B2 * | 11/2002 | Kokkersvold et al. | 53/447 |
| 6,558,108 | B1 | 5/2003 | Van Oord | |
| 7,096,650 | B2 * | 8/2006 | Van Dam | 53/540 |
| 2005/0145643 | A1 | 7/2005 | Van den Brink et al. | |

FOREIGN PATENT DOCUMENTS

| | | |
|---|---|---|
| EP | 0 042 199 | 12/1981 |
| FR | 2 558 453 | 7/1985 |
| JP | 05270513 A * | 10/1993 |

* cited by examiner

*Primary Examiner*—Stephen F Gerrity
(74) *Attorney, Agent, or Firm*—Stites & Harbison PLLC; Marvin Petry

(57) ABSTRACT

The present invention relates to an apparatus and method for placing patterns of product holders, more in particular placing stacks of layers of the holders, into boxes or crates, using a supporting band, cords or strips, whereby the use of complex gripper heads is avoided. Thus, a considerably cheaper packing process is obtained.

15 Claims, 1 Drawing Sheet

METHOD AND APPARATUS FOR FILLING CONTAINERS INCLUDING A SUPPORTING BAND

Figure 1:
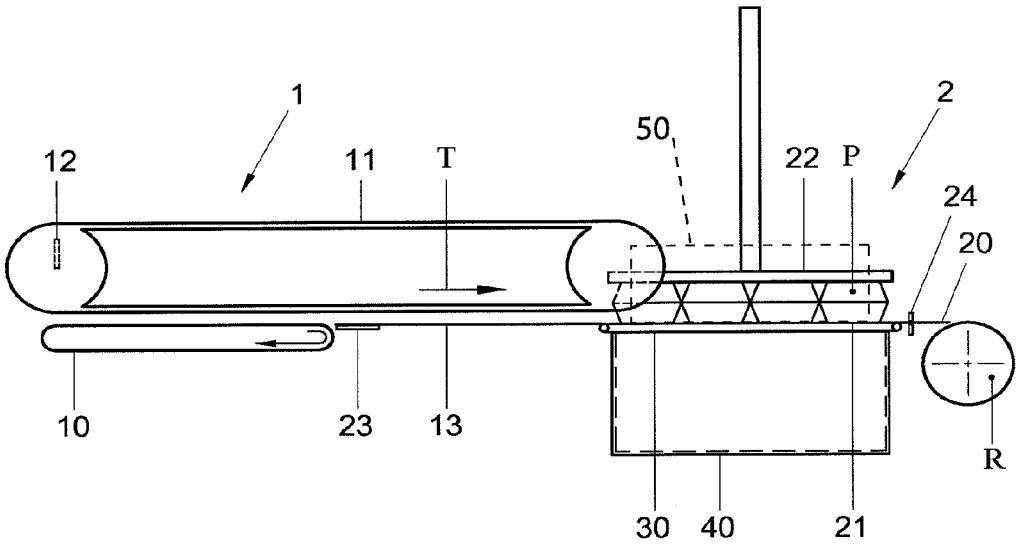

The present invention relates to an apparatus and method for filling boxes or crates.

Such an apparatus is known from EP1502884, which describes how egg boxes grouped into patterns are picked up with a gripper and can be placed in a larger box or crate. These patterns form a layer in the box or crate. In particular, a construction with so-called intermediate plates is shown which are arranged between the egg boxes, such that the pattern is thereby prevented from falling apart, or the boxes from opening undesirably, during pick-up by the gripper. Although this construction has proved successful, practice has shown that the many types of egg boxes typically require their own type of intermediate plate.

Another type of apparatus is shown and described in U.S. Pat. No. 4,192,121, which describes how stacks of trays or holders for e.g. eggs can be placed in a larger box or crate. Layer arrays are carried by means of a transfer plate onto stack forming means. Next, the stack forming means are retracted, so that the stack formed rests on flexible sheets which are positioned horizontally by means of leaf springs and can be unwound. These sheets, during unwinding, under the influence of the leaf springs, can be brought to a vertical position to allow the stack formed to be lowered into the box.

Although such a set-up shows a controlled manner of packing said trays, it will be clear that it does not enable handling and transferring patterns to be placed in boxes or crates.

To obviate the shortcomings mentioned, the apparatus according to the invention is characterized in that it comprises:

- an endless feeding conveyor for feeding packaging units in a transport direction T;
- a pattern former for grouping the fed packaging units into well-defined patterns placed in a substantially horizontal surface; and
- a transfer unit for transferring said packaging units grouped in patterns, into said boxes, said patterns forming substantially horizontal layers in the boxes;

wherein the transfer unit comprises:

- at least one supporting band for supporting a said pattern on a substantially horizontal supporting surface portion thereof;
- a first transport element for moving the pattern off the feeding conveyor to a position on or above the supporting band above said, opened, box or crate; and
- a mechanism configured for moving the supporting band for the purpose of placing each pattern supported by the supporting band into said box or crate, in particular such that the supporting surface portion maintains a substantially horizontal position.

With such an apparatus, with great advantage, many types of patterns can be packaged in boxes or crates in a simple manner. The above-mentioned package-specific apparatus has thus become redundant.

In a further elaboration, the apparatus is configured in a simple manner to lower a lowermost horizontal stacking pattern layer, which rests on the supporting band, stepwise into the box or crate during the further formation of the stack.

According to an advantageous elaboration, said mechanism is arranged for at least partly removing and/or interrupting the supporting band after placement of the pattern in said box or crate.

According to an advantageous elaboration, said supporting band extends at least continuously along a first position above a first upper edge of said box or crate to a second position above an opposite second upper edge of said box or crate, at least to receive a said pattern. Preferably, the supporting band possesses at least substantially the length, calculated in the tensioning direction of the supporting band, of that of the supporting surface portion and twice the (vertical) depth of a said box or crate, and wherein the supporting band is preferably movable and placeable from a supporting band feeding device, in particular a roll from which the supporting band can be unrolled.

According to an advantageous elaboration, the transfer unit is provided with a second transport element for moving the pattern, functioning as a layer, supported by the supporting band, downwardly and placing it in said, opened, box or crate.

According to an advantageous elaboration, the mechanism comprises a supporting band interrupter, such as a cutter, for at least partly removing the supporting band after placement of the pattern in the box or crate.

According to an advantageous elaboration, the transfer unit is provided with a supporting band tensioner for providing and tensioning the supporting band above said box or crate In further exemplary embodiments of the invention, the apparatus is characterized in that the at least one supporting band extends in the transport direction T; or that the at least one supporting band extends perpendicularly to the transport direction T; and/or that the transfer unit is furthermore arranged to provide an extra supporting surface or supporting plate on the at least one supporting band prior to displacement of the pattern from the feeding conveyor to a position on the supporting band above said opened box or crate.

In further elaborations, the invention is characterized in that the transfer unit furthermore comprises two vertical supporting plates, arranged at two opposite walls of the box or crate between the packaging units and the parts of the supporting band extending along these walls; that the supporting plate consists of a substantially thin sheet of cardboard; and that the supporting band consists of strips, sheets, or cords, or combinations thereof, of material suitable for the purpose.

Furthermore, a method for filling boxes or crates, with packaging units, is characterized according to the invention in that it comprises:

- placing a said box or crate on a filling location;
- feeding packaging units on an endless feeding conveyor;
- grouping the fed packaging units into well-defined patterns placed in a substantially horizontal surface; and
- transferring said packaging units grouped in patterns into said boxes or crates, wherein a said pattern forms at least one substantially horizontal layer in said boxes or crates;

wherein transfer comprises the following cycle of consecutive steps:

a) providing at least one supporting band in a substantially horizontal supporting surface above an open box or crate;
b) placing packaging units grouped in a pattern, from the feeding conveyor onto the supporting band above the open box or crate;
c) moving the supporting band, such that the pattern thereby supported lowers as a substantially horizontal layer into the box or crate, with the upper side of the pattern functioning either as a substantially horizontal supporting surface for a next pattern to be placed or as a top layer of the only pattern of packaging units to be placed in the box or crate;
d) in the situation where multiple layers are to be placed in the box or crate, placing a next pattern of packaging units from the conveyor onto said supporting surface of the upper side of a preceding placed pattern; and e) repeating the steps c) and d) until a next top layer has been reached.

The above cycle can be repeated, for instance to fill multiple boxes or crates in succession.

In a suitable manner, this procedure enables layer-by-layer placement, furthermore allowing the possibility of providing a different pattern per layer. This pattern can moreover be a subpattern of the subjacent layer, depending on the filling requirements of the box or crate.

In a further embodiment, the method of the invention furthermore comprises a step f) in which the supporting band is at least partly drawn in.

Further, it is advantageous when the method after step e) and for instance a repeat of the cycle, comprises a step of at least interrupting the supporting band, and discharging the filled box or crate for further processing.

A major advantage of the above-mentioned invention is to be seen in the entire avoidance of complex gripper constructions. This is precisely why a considerably cheaper packing process is obtained.

A further advantage is that the box or crate can always be held at a same height during transport and filling.

Further details will be discussed with reference to two figures, with

Figure 2:
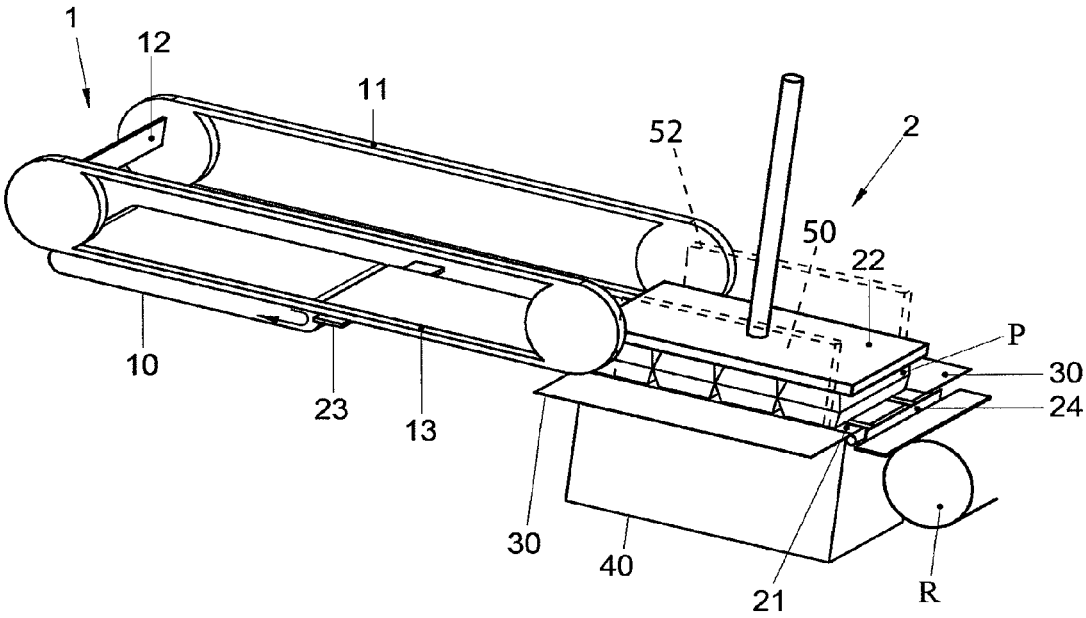

FIG. 1 schematically showing an exemplary embodiment of the invention in side elevation, and FIG. 2 schematically showing the embodiment according to FIG. 1 in isometric view.

In these two figures, the same parts or components are designated by the same numbers.

In FIGS. 1 and 2, a feeding device 1 is indicated for feeding packaging units P with a feeding conveyor 10 in transport direction T and then forming them into patterns with a pattern former 11. Packaging units P are, for instance, egg boxes, having a size, expressed in eggs, of 2×3, 2×4, 2×5, or 2×6, or still others. The patterns formed are thereupon supplied to a transfer unit 2. In general, this transport direction is substantially horizontal.

More particularly, for positioning the units P, use is made of a first transport element or pusher plate 12. It will be clear to anyone skilled in the art that the interaction of speeds of the feeding conveyor 10 and of the pattern former 11 with pusher plate 12 determines whether the units P are pushed forward or stopped. Generally, the feeding conveyor 10 is an endless belt. In a suitable manner, the material of this belt can be chosen such that when the pusher plate 12 is used to stop the upstream units P, this belt offers such resistance or friction that the units P remain in place in pushed position while the belt rotates under them. When the proper number of units P has been brought together on the feeding conveyor 10 and formed into the desired pattern with the pusher plate 12, this pattern is shoved on to a buffer plate 13, arranged approximately equally high.

From this buffer plate 13, with said pusher plate 12, the ready pattern is advanced to the transfer unit 2. This transfer unit 2 comprises a single, tensionable supporting band 20 which is arranged on a roll R and can be unrolled from it, for instance against the transport direction T. However, it is also very well possible to tension a supporting band not in the direction T but perpendicular thereto, which may be determined by the pattern of packaging units P to be packed. On its side remote from the roll R, the supporting band 20 is engaged by a supporting band tensioner 23 which is indicated in FIGS. 1 and 2 approximately at the beginning of the buffer plate 13. Such tensioning is preferably carried out such that when the supporting band is pushed upon from above (for instance by a second transport element or press-on plate 22), the supporting band yields and at the same time remains tensioned. For that purpose, generally known and suitable unwinding and tensioning devices are used. The supporting band 20 extends closely over an opened box or crate 40, with the portion above the opened box or crate forming a supporting surface portion 21. On that portion, the pattern is placed to be subsequently lowered into the box or crate 40 positioned there. Such a supporting band will be made of a material suitable for that purpose, for instance plastic, or also a well-defined type of paper. As is clearly visible in FIGS. 1 and 2, the supporting band 20 extends continuously (without interruption) above the entire upper side of the box or crate 40 to be filled, at least extends in particular continuously above that upper side along a first position above a first upper edge of the box or crate and a second position above an opposite second upper edge of the box or crate, at least to receive a said pattern.

It will be clear to those skilled in the art that the supporting band tensioner 23 may also be arranged further downstream, though always allowing for the necessary working length for the supporting band, taking into account the magnitude of the opening of the box or crate and twice the height (i.e. depth) thereof, for which magnitude generally the length of the supporting surface portion 21 in the tensioning direction is taken.

Depending on the pattern of units P, the supporting band, for supporting the pattern in a suitable manner, can be a flat continuous band, or also a system of strips, bands, or cords, or even a combination of the foregoing. Correspondingly suitable rolls R and tensioners will be used. Bringing each pattern P brought onto the supporting surface portion 21 into the box or crate 40 can be done by suitably moving, in particular veering, the supporting band 20, so that the supporting surface portion 21 with the pattern P moves down. Preferably, the supporting surface portion 21 then maintains a substantially horizontal position. Also, a second transport element or press-on plate 22 may be provided, to push the pattern or a stack of patterns P supported by the supporting surface portion 21 downwards at a desired time.

After in general the pattern P at the opening of the box or crate has been brought down into this box or crate 40, a next pattern can be shoved in line on the preceding one. The upper side of the preceding pattern then forms the next supporting surface portion. Alternatively, only one pattern may be brought into a box by the present apparatus and method.

As soon as the proper stacking of patterns has been achieved and the lowermost pattern has reached the bottom of the box or crate 40 in the intended manner (in particular when the supporting surface portion 21 of the supporting band 20 has reached the box/crate bottom, at least with the lowermost layer placed on the bottom of the box or the crate), then with a supporting band interrupter 24, such as a cutter, at least a part of the supporting band 20 can be interrupted, i.e. cut or separated, from the remaining supporting band 20. This can mean that both at the tensioner 23 the supporting band 20 is cut and the entire band is rolled back again, and that at the roll R, the band 20 is cut, whereby during closure or further transit of the box or crate, the used band 20 (at least a used. i.e. cut, supporting band part separated from the roll R) is left in the box 40. It will be clear to those skilled in the art that further possibilities for use of the band can be applied.

After the box or crate 40 has been filled in the desired manner and subsequently been carried off, then with the tensioner the end of the band is engaged and re-tensioned, allowing, after placement of a next box or crate 40, a next filling cycle to be started.

Bringing the pattern into the box can be carried out in different ways. For instance, the band may be veered uniformly on both sides of the box or crate, so that the pattern likewise lowers uniformly. In the exemplary embodiment shown, however, a second transport element or press-on plate 22 has been opted for. This will push down the pattern or the stack of patterns (supported on the supporting surface portion 21 of the band 20) at the proper time.

Furthermore, in the figures, pattern supporting plates 30 are indicated, onto which the patterns are initially pushed from the buffer plate 13, after which these pattern supporting plates 30 are moved clear and a pattern with units P lowers onto the supporting surface portion 21, or onto the upper surface of a preceding pattern.

In a further exemplary embodiment of the present invention, the supporting surface portion 21 of the supporting band 20, prior to providing the first pattern thereon, is strengthened with an extra supporting surface (not shown), for instance a cardboard plate. In general, this extra supporting surface will be left in the box or crate after interruption of the supporting band as elucidated hereinabove.

With such a supporting plate/extra supporting surface, both the tensioning force in the supporting band 20 can be taken up, so that a said pressing-on can be carried out with less force, and also any undue bending in case of a pattern of juxtaposed units can thus be obviated.

In a further embodiment, it is also possible to provide supporting band parts, such as vertical supporting plates 50, 52, vertically between the two opposite vertical longitudinal walls of the box or crate, and hence on opposite sides of a pattern of units. In this way, too, the tension force in the supporting band 20 is taken up.

To anyone skilled in the art, it will be apparent from the foregoing how the cycle proceeds after a box or crate has been arranged at a proper position or filling location. A method as indicated in the introduction of the description can then be practiced. Further, it is to be taken into account that readily apparent modifications and additions to the apparatus or to the method are understood to fall within the scope of protection of the appended claims.

To those skilled in the art, it will be clear that the invention is not limited to the exemplary embodiments described. Various modifications are possible within the framework of the invention as set forth in the following claims.

The invention claimed is:

1. An apparatus for filling a container with packaging units, said apparatus comprising:

an endless feeding conveyor for feeding packaging units in a transport direction T;

a pattern former for grouping the fed packaging units into well-defined patterns placed on a substantially horizontal surface, the pattern former including a pusher plate extending substantially perpendicularly to the transport direction T and being controllably moveable in the transport direction above the feeding conveyor so that packaging units may be stopped by the pushing plate and may be pushed in the transport direction T by the pusher plate so that patterns of packaging units may be formed by co-operation of the endless feeding conveyor and the pusher plate; and a transfer unit for transferring said patterns of packages, into said container, so that said patterns form substantially horizontal layers in the container, the transfer unit comprising:

at least one supporting band including a substantially horizontal supporting surface portion for supporting one of said patterns;

a pusher plate being arranged for moving the pattern from the feed conveyor to a position on or above the supporting band above said container;

a mechanism configured for moving the supporting band for the purpose of placing each pattern supported by the supporting surface portion in said container, such that the supporting surface portion maintains a substantially horizontal position;

a supporting band roll from which the supporting band is unrolled;

a supporting band tensioner that engages a free end of the supporting band; and a supporting band cutter, wherein the supporting band cutter is configured for separating the band adjacent the supporting band tensioner.

2. The apparatus according to claim 1, wherein said mechanism is arranged for removing at least a part of the supporting band after placement of the pattern in said container.

3. The apparatus according to claim 1, wherein said supporting band extends continuously from a first position above a first upper edge of said container to a second position above an opposite second upper edge of said container, to receive one of the patterns, and wherein the supporting band has a length of at least the sum of the length of the supporting surface portion and twice the depth of the container.

4. The apparatus according to claim 1, wherein the transfer unit is provided with a press-on plate to push the pattern or a stack of subsequently formed patterns supported by the supporting surface portion downwards in the container.

5. The apparatus according to claim 1, wherein the supporting band is unrolled from the roll in the transport direction T.

6. The apparatus according to claim 1, wherein the supporting band is unrolled from the roll in a direction perpendicularly to the transport direction T.

7. The apparatus according to claim 1, wherein the transfer unit is arranged to provide an extra supporting surface or supporting plate on the supporting band prior to displacement of the pattern from the feeding conveyor to a position on the supporting band above said open container.

8. The apparatus according to claim 7, wherein the extra supporting surface or the supporting plate consists of a substantially thin sheet of cardboard.

9. The apparatus according to claim 1, wherein the transfer unit includes two vertical supporting plates, arranged at two opposite walls of the container between the packaging units and the parts of the supporting band extending along these walls.

10. The apparatus according to claim 1, wherein the supporting band is selected from the group consisting of strips, sheets, cords, and combinations thereof.

11. The apparatus according to claim 1, wherein the supporting band cutter is configured for separating the band adjacent the supporting band roll.

12. A method for filling a container with packaging units, comprising:

placing the container in a filling location;

feeding packaging units on an endless feeding conveyor;

grouping the fed packaging units into well-defined patterns placed in a substantially horizontal surface; and transferring subsequent patterns into the container, wherein each pattern forms a substantially horizontal layer in the container, wherein transfer comprises the following cycle of consecutive steps:

a) providing at least one supporting band so that a supporting surface portion thereof extends substantially horizontally above an open top of the container;

b) placing one of the patterns from the feeding conveyor onto the supporting band above the container;

c) moving the supporting surface portion of the supporting band into the container, so that the pattern supported by the supporting surface portion lowers as a substantially horizontal layer into the container, with an upper side of the pattern functioning either as a substantially horizontal supporting surface for a subsequent one of the patterns to be placed or as a top layer of a final pattern to be placed in the container; and d) using a supporting band cutter to separate the supporting band after the final pattern has been placed on the top layer or the supporting surface portion.

13. The method of claim 12, wherein the supporting band is removed from the container after separating the band.

14. The method of claim 12, wherein the supporting band is left in the container after separating the band.

15. The method of claim 12, including:

e) placing multiple layers in the container by placing a subsequent pattern of packaging units from the conveyor onto the upper side of a preceding pattern; and f) repeating the steps c) and e) until the final pattern has been placed.

* * * * *